US005332875A

United States Patent [19]

Grant

[11] Patent Number: 5,332,875

[45] Date of Patent: Jul. 26, 1994

[54] SHOCK SENSOR SWITCH

[75] Inventor: John T. Grant, Reepham, England

[73] Assignee: Grant Design Limited, Reepham, England

[21] Appl. No.: 976,390

[22] Filed: Nov. 13, 1992

[30] Foreign Application Priority Data

Nov. 13, 1992 [GB] United Kingdom ..... 9124052

[51] Int. Cl.[5] ..... H01H 35/14

[52] U.S. Cl. ..... 200/61.45 R; 200/61.51

[58] Field of Search ..... 200/61.45 R, 61.48, 200/61.49, 61.52, 61.83; 73/649, 652, 517 AU; 340/566, 669, 686, 689

[56] References Cited

U.S. PATENT DOCUMENTS

| | | | |
|---|---|---|---|
| 4,085,304 | 4/1978 | Hasler | 200/61.45 R |
| 4,361,740 | 11/1982 | Stockdale | 200/61.45 R |
| 4,686,335 | 8/1987 | Grant | 200/61.45 R |
| 5,053,589 | 10/1991 | Grant | 200/61.45 R |

FOREIGN PATENT DOCUMENTS

| | | | |
|---|---|---|---|
| 2171202 | 8/1986 | United Kingdom | H01H 35/4 |

*Primary Examiner*—A. D. Pellinen
*Assistant Examiner*—Michael A. Friedhofer
*Attorney, Agent, or Firm*—Burns, Doane, Swecker & Mathis

[57] ABSTRACT

A vibration sensitive switch has a pair of spaced apart parallel contacts contained within a switch body and a movably supported tubular mass inside a chamber in the body. The mass is supported by conductive men, bets in the form of two pairs of contact bars secured at each end of the tubular mass and located between the two contacts so that both sets of bars are in electrical contact and resting on and between them by force of gravity. The contact bars are suitably arranged to cross each other at the axial center of the tubular mass and angled to provide a wedging action when at rest thus providing higher contact pressure than would normally be obtained.

12 Claims, 2 Drawing Sheets

SHOCK SENSOR SWITCH

BACKGROUND OF THE INVENTION

The invention relates to a vibration switch, particularly but not exclusively for use in security systems to detect vibration through building structures during a forcible entry.

The operation of such switches relies on an electrical connection being maintained by means of gravity acting upon a free moving mass connected to or part of the electrical circuit. The body of the switch is normally firmly attached to the building structure. During vibration, the switch body and associated fixed electrical contacts will move, whereas the mass will tend to remain relatively stationary due to inertia effects.

During vibration, the electrical circuit will be opened and closed rapidly as the mass loses contact with its points of rest. The electrical signals obtained may be suitably analysed and processed by electronic circuits and, provided pre-set conditions are met, be used to signal an alarm condition.

Numerous different switch designs are in use but most suffer from certain disadvantages. It is known to provide a sensor switch with conductive circular cross-section bars as bridging conductors between a pair of contacts which are perpendicular to the bars, the resulting electrically parallel connections between the contacts being disturbed when the sensor is vibrated due to relative movement of a mass supported by the bars. U.S. Pat. No. 4,686,335 discloses an arrangement in which the force applied to the bars is increased by a leverage principle, allowing use of a smaller mass. However, experience has shown that occasional high resistance or open-circuit conditions at the contact points may be caused by microscopic particles of foreign matter, oxides or polymer contamination from impurities migrating through the relatively porous gold contact plating which is often used.

The present invention seeks to overcome the problem of occasional false alarm conditions due to contact contamination.

SUMMARY OF THE INVENTION

According to the present invention we propose a vibration sensitive switch comprising a body part and a movable mass part, the body part including a pair of electrical contacts for connection in an electrical circuit, and the mass part including a bridging conductor for providing a bridging connection between the contacts which is interrupted when relative movement between the body part and the mass part occurs due to vibrations to be detected, wherein one of the said parts defines a wedge which is received in a receptacle defined by the other of the said parts, the wedge being arranged to bear against opposite sides of the receptacle such that the mass part is supported with respect to the body part, and wherein the contacts and the bridging conductor are associated with interengaging surfaces of the wedge and the sides of the receptacle, whereby movement the wedge out of engagement with the receptacle sides results in the interruption of the bridging connection.

Preferably, the contacts comprise a pair of substantially parallel elongate contact members forming the side of the receptacle, and the bridging conductor comprises at least one pair of mutually inclined and electrically interconnected bars arranged in a cruciform with the included angle being less than 90° so as to form opposite sides of two wedges, the bars being generally perpendicular to the contact members.

The mass part may be tubular with a central axis parallel to the contact members, the contact members being located within the interior space of the tubular mass part. The bridging conductor may constitute or form part of the mass part and may include two spaced-apart pairs of mutually inclined and electrically interconnected bars perpendicular to the contact members and extending across opposite open ends of the mass part.

DESCRIPTION OF THE PREFERRED EMBODIMENT

Figure 1:
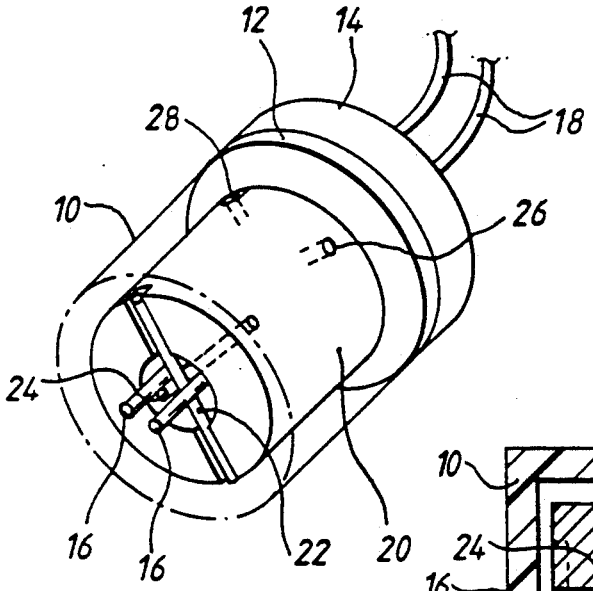
FIG. 1 is a diagrammatic perspective view of a vibration sensitive switch in accordance with the invention.
Figure 3:
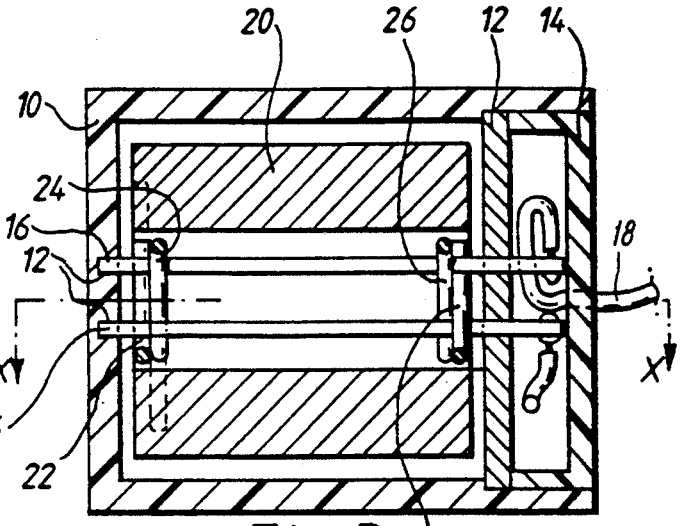
FIG. 3 is a longitudinal cross-section on the line III—III in FIG. 2.

Referring to the drawings, a vibration sensitive switch in accordance with the invention has a body part 10 in the form of a hollow housing or casing made of an electrically insulating material such as polypropylene or nylon. The housing is closed at both ends, one end portion comprising the combination of an insulating insert 12 and sealing cap 14 both also made of an insulating material such as polypropylene or nylon. Extending between the two ends of the housing are two electrically conductive elongate parallel contact members 16 each in the form of bars of circular cross-section. Each contact men, bet 16 penetrates the insert 12 to form terminals for the connection of lead wires 18.

Figure 5:
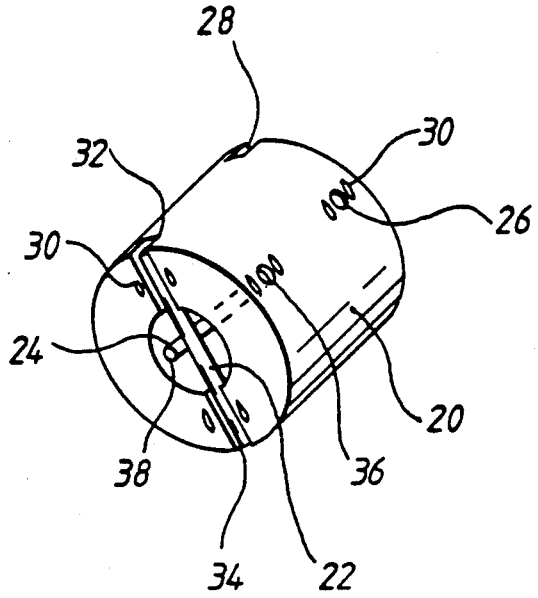
FIG. 5 is a perspective view of an inertia mass of the switch of FIG. 1.

Housed within the interior space of the housing is a tubular inertia mass 20 made of a non-ferrous metal. This mass 20 includes two pairs of electrically conductive bars 22, 24 and 26, 28 housed in slots and holes cut in the tubular mass 20. The bars of each pair are arranged in a cruciform with an included angle of less than 90°, the intersection of the bars occurring at the central longitudinal axis of the tubular mass so as to be between the two contact members 16. As will be seen from FIG. 2, these bars 22, 24 and 26, 28 serve to support the tubular mass 20 in the housing 10, the bars of each pair forming a wedge exerting oppositely directed lateral forces on each of the contact members by virtue of the gravitational force on the mass 20. The bars 22, 24 and 26, 28 are metallic and gold plated and are electrically connected with the material of the mass part 20 by peening or pinching features or burrs 30 as shown in FIGS. 2 and 5, to form parallel conducting bridging paths between the contact members when the tubular mass 20 is in the position shown in FIG. 2.

A first bar 22 of the bridging conductors extends across one end of the tubular mass 20 and is housed in slotted recesses 32, 34 cut in the outer end face of the mass 20. Adjacent to the first bar 22 is a second bridging conductor bar 24 spanning the interior space of the tubular mass 20 at an angle to the first conductor bar 22. This second bar is fitted in holes 36, 38 drilled through the wall of the tubular mass 20. Bridging conductor bars 26 and 28 are similarly located at the other end of the mass 20.

It will be seen that each pair of bridging conductor bars are positioned to cross close to one another at the approximate axial centre of the mass at a relative angle of some 60°.

Figure 2:
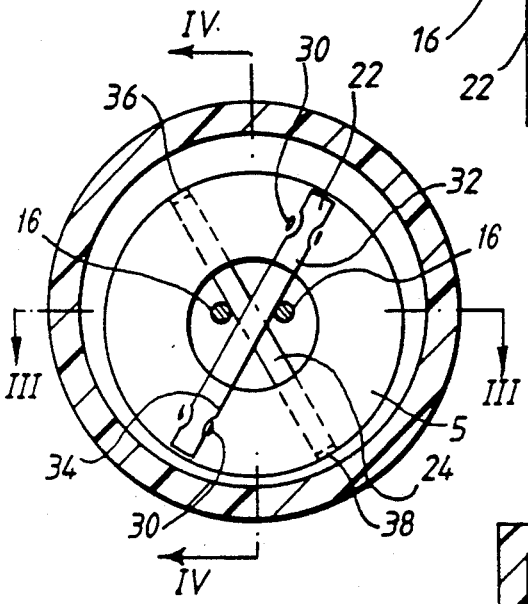
FIG. 2 is a transverse cross-section of the switch of FIG. 1.
Figure 4:
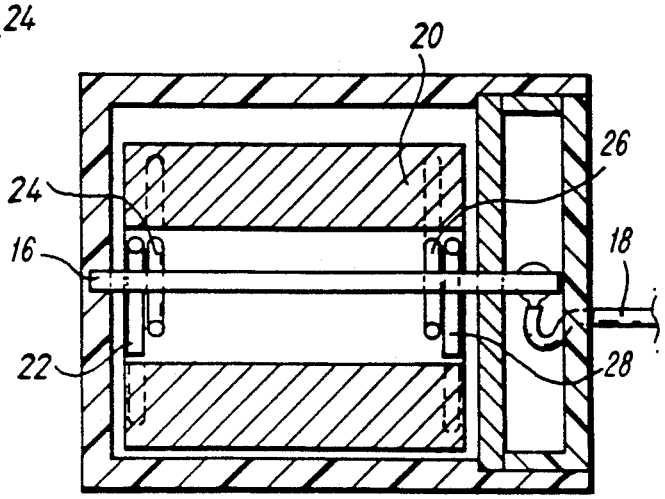
FIG. 4 is a longitudinal cross-section on the line IV—IV in FIG. 2.

When the assembled switch is disposed in the in-use position as shown in FIG. 2 with its longitudinal axis generally horizontal and the fixed contact members 16 in a horizontal plane, the force of gravity urges the inertia mass and its associated conductor bars downwardly to rest on and between the contact members 16 in a wedging action so as to provide two parallel current paths between the terminal ends of the contact members 16. It will be appreciated that there are two possible orientations of the switch which fall within the above description, one position being with the switch rotated through 180° about its axis with respect of the other.

Figure 6:
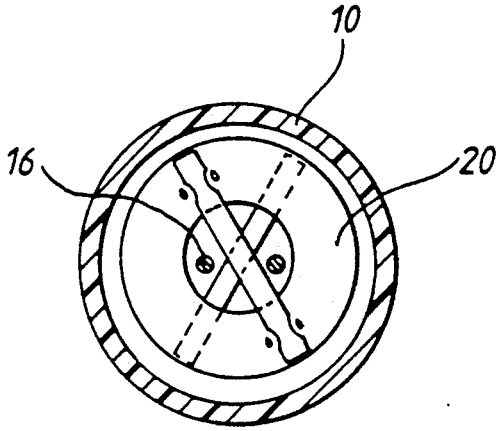
FIG. 6 is a cross-section corresponding to that of FIG. 2 showing the position of the inertia mass when the switch is in an open-circuit condition.

When the structure to which the switch is attached is subject to shock, the mass 20 moves relative to the housing 10 so that the bridging conductor paths 22, 24 and/or 26, 28 momentarily lose contact with one or both of the contact members 16, as shown in FIG. 6, to break the electrical circuit between the terminal ends of the contact members 16.

The bridging action of the bridging conductor bars 22, 24 and 26, 28 produces relatively high contact forces at the points of contact with the contact members 16 to lessen the chance of false alarms due to contamination of the interengaging contact surfaces. In addition, the provision of two sets of bridging conductor bars, providing two parallel bridging conductor paths lessens the chance of false alarms.

Preferably, both the conductor bars 22, 24, and 26, 28 and the contact members 16 are coated or plated with a noble metal such as geld to minimise contact resistance.

It will be appreciated that the angle of intersection of the bridging conductor bars may be varied to produce different sensitivity to vibration, so that, for example, bars with an intersecting angle of 90° may produce a switch which is more sensitive to vibrations than one having bars at an intersecting angle of say 40° due to the difference in wedging action between the contact members 16.

Preferably, the body part (the housing) 10 and the inertia mass 20 are both of circular cross-section. However, other cross-sections such as square or rectangular may be used. The outer casing part of the housing as well as the mass 20 may be metallic and formed by metal extrusion.

In addition, the bridging conductor bars and the contact members may be of a sectional profile other than circular, for example square or rectangular, arranged so that the corners of such profiles for cross-point or cross-bar type contacts having small areas of contact and corresponding high contact pressures.

In summary, I have disclosed a vibration sensitive switch in which the mass is suspended relative to spaced contacts in the body such that in an in-use position of the switch, gravity acting on the mass urges contact bridging means into a normally closed position. The contact bridging means is, preferably, mounted across the open ends of the tubular mass and arranged to intersect each other to form a diagonal cruciform, thus when at rest, both sets of contact bridging means will produce a wedging action upon the fixed spaced apart contacts in the body producing a higher contact pressure than otherwise would be produced if bridging means were horizontally arranged and merely resting upon the contacts.

Both sets of bridging means are electrically connected together to provide two parallel current paths thus significantly reducing the possibility of false alarms.

What is claimed is:

1. A vibration sensitive switch comprising a body part and a movable mass part, the body part including a pair of electrical contracts for connection in an electrical circuit, and the mass part including a bridging conductor for providing a bridging connection between the contacts which is interrupted when relative movement between the body part and the mass part occurs due to vibrations to be detected, wherein the bridging conductor comprises at least one pair of mutually inclined and electrically interconnected bars which form opposite sides of a wedge which is received in a receptacle defined by the contacts, the wedge being arranged to bear against opposite sides of the receptacle such that the mass part is supported with respect to the body part, and wherein the contacts and the bridging conductor are associated with interengaging surfaces of the wedge and the sides of the receptacle, whereby movement of the wedge out of engagement with the receptacle aides results in the interruption of the bridging connection.

2. A switch according to claim 1, wherein the contacts comprise a pair of substantially parallel elongate contact members forming the sides of the receptacle, and wherein the mutually inclined bars are generally perpendicular to the said contact members.

3. A switch according to claim 2, wherein the mass part is tubular and has a central axis parallel to the contact members, wherein the contact members form part of the body part and are located within the interior space of the tubular mass part, and wherein the bridging conductor is at least part of the mass part and includes two spaced apart pairs of mutually inclined and electrically interconnected bars perpendicular to the said contact members and extending across opposite open ends of the mass part.

4. A switch according to claim 3, wherein the bars of each said pair form a cruciform with an intersection located between the said contact members, wherein each bar has two ends housed in the mass part, and wherein the mass part is formed of electrically conductive material.

5. A switch according to claim 4, wherein the angle of intersection of the bars is less than 90°.

6. A switch according to claim 3, wherein the pairs o#interconnected bars form parallel electrical current paths between the contact members.

7. A switch according to claim 1, wherein the body part comprises a hollow housing containing the mass part, and wherein the contacts comprise a pair of parallel elongate contact members secured in opposite end portions of the housing.

8. A switch according to claim 7, wherein the contact members are bars of circular cross-section.

9. A switch according to claim 4, wherein the electrically interconnected bars are housed in slots or holes in the tubular mass part.

10. A switch according to claim 9, wherein the bars are retained in and electrically connected to the mass part by burrs adjacent the edges of the slots or holes.

11. A switch according to claim 1, wherein the contacts and the bridging conductor are plated with a noble metal.

12. A switch according to claim 1, wherein said mass part has a longitudinal axis substantially intersecting a point of intersection of said pair of bars.

* * * * *